US007562691B2

(12) United States Patent
Guerche et al.

(10) Patent No.: US 7,562,691 B2
(45) Date of Patent: Jul. 21, 2009

(54) CORE FOR TURBOMACHINE BLADES

(75) Inventors: Didier Guerche, Conflans Ste Honorine (FR); Jean-Claude Hanny, Paris (FR); Serge Prigent, Asnieres sur Seine (FR)

(73) Assignee: SNECMA, Pris (FR)

( * ) Notice: Subject to any disclaimer, the term of this patent is extended or adjusted under 35 U.S.C. 154(b) by 141 days.

(21) Appl. No.: 11/460,091

(22) Filed: Jul. 26, 2006

(65) Prior Publication Data

US 2007/0025851 A1 Feb. 1, 2007

(30) Foreign Application Priority Data

Jul. 29, 2005 (FR) ..... 05 08154

(51) Int. Cl.
*B22C 9/04* (2006.01)
*B22C 9/10* (2006.01)

(52) U.S. Cl. ..... 164/28; 164/361; 164/369; 164/516

(58) Field of Classification Search ..... 164/516–519, 164/28, 361, 369
See application file for complete search history.

(56) References Cited

U.S. PATENT DOCUMENTS 5,599,166 A * 2/1997 Deptowicz et al. ..... 416/97 R
5,853,044 A * 12/1998 Wheaton et al. ..... 164/516
5,951,256 A 9/1999 Dietrich
6,929,054 B2 * 8/2005 Beals et al. ..... 164/369
2004/0020629 A1 * 2/2004 Shah et al. ..... 164/369
2004/0112564 A1 * 6/2004 Devine et al. ..... 164/369

FOREIGN PATENT DOCUMENTS

EP 1 306 147 A1 5/2003
EP 1 543 896 A2 6/2005
EP 1 557 229 A2 7/2005

* cited by examiner

*Primary Examiner*—Kuang Lin
(74) *Attorney, Agent, or Firm*—Oblon, Spivak, McClelland, Maier & Neustadt, P.C.

(57) ABSTRACT

The present invention relates to a ceramic core used in the manufacture, by lost wax casting, of a turbomachine blade with cooling cavities and a squealer, comprising at least one main core, wherein the main core (10) comprises an element (10B) shaped so as to constitute the squealer and an element (10SB) shaped so as to constitute at least one cavity beneath the squealer, the two elements leaving between them a space (13) shaped so as to constitute, at least in part, the bottom wall of the squealer. In particular, the elements (10B and 10SB) are joined together by ceramic rods (TG).

9 Claims, 4 Drawing Sheets

CORE FOR TURBOMACHINE BLADES

FIELD OF THE INVENTION

The present invention relates to the field of turbomachine blades, especially to that of blades obtained by casting a molten alloy in a mold using the technique of lost wax casting.

PRIOR ART

The search for enhanced performance levels in engines involves in particular more effective cooling of the turbine blades located immediately downstream of the combustion chamber. This requirement means that more elaborate internal cavities have to be formed inside these blades for the circulation of the cooling fluid. These blades have the particular feature of having several metal walls and therefore require the manufacture of increasingly complex ceramic cores.

The technique of manufacturing blades of this type therefore includes a first step of forming the core. The core is made of a ceramic with a generally porous structure and is produced from a mixture consisting of a refractory filler in the form of particles and a relatively complex organic fraction forming a binder. Examples of compositions are given in patents EP 328 452, FR 2 371 257 and FR 1 785 836. As is known, the cast core is formed by molding, for example using an injection molding machine. This forming is followed by a binder-removal operation during which the organic fraction of the core is removed by a means such as sublimation or thermal degradation, depending on the materials used. This results in a porous structure. The core is then consolidated by heat treatment in a furnace. A finishing step may be necessary in order to remove and deflash the traces of parting lines and to obtain the desired geometry of the core. Abrasive tools are used for this purpose. It may also be necessary to reinforce the core so that it is not damaged during subsequent operating cycles. In this case, the core is impregnated with an organic resin.

Next, a pattern, made of wax or another, equivalent material, is molded over the core, so as to constitute a replica of the blade to be cast. In the next step, of forming the mold for casting the alloy, the pattern is dipped into slips so as to constitute a ceramic shell. The wax is then removed so as to leave a space in the shell mold, into which the alloy will be cast. After the metal has been cast and cooled, the shell mold is broken and the core removed in order to free the part.

Owing to the complexity of the cooling cavities to be formed with their separate partitions, and owing to their arrangement, the core is produced in several portions, which are then assembled and bonded. The elementary cores are generally linked together at the root and at the tip. This requires the thickness of the walls and of the partitions formed to be carefully controlled during casting. The assembly operation must allow the core to withstand the stresses undergone during the wax injection, dewaxing and then casting steps.

The current techniques known to the present Applicant do not, however, allow the squealer at the blade tip to be obtained directly by casting.

SUMMARY OF THE INVENTION

It will be recalled that the squealer is the cavity at the blade tip radially open to the outside. An example of a squealer may be seen in FIG. 1, which shows a hollow blade 1. The root 2 of the blade, via which it is mounted on a turbine rotor, the platform 3 and the airfoil 4 can be seen. The airfoil is hollow and includes, at its tip, on the opposite side from the platform, a cavity referred to as the squealer 5. This squealer 5 is bounded laterally by the wall of the airfoil and the bottom is formed by the bottom wall 6 of the squealer, perpendicular to the radial axis of the airfoil. This bottom wall, which may be seen in section in FIG. 2, is drilled with orifices 61 that communicate with the internal cavities of the airfoil, in order to extract some of the fluid for cooling said airfoil. This fluid is itself discharged into the hot gas stream via the clearance that exists between the tip and the annular surface of the stator.

At the present time, a hollow blade with its cavities is produced by casting using the method presented above, but without the squealer bottom wall. The wall is added, in the form of a plate, to the as-cast blade and fastened by brazing. This operation is lengthy and expensive.

It would therefore be desirable to be able to produce this bottom wall without having to perform the brazing operation.

This objective can be achieved according to the invention with a ceramic core used in the manufacture, by lost wax casting, of a turbomachine blade with internal cooling cavities and a squealer, formed, in particular, by assembling cores, comprising at least a main core, wherein the main core comprises an element shaped so as to constitute the squealer and an element shaped so as to constitute at least one cavity beneath the squealer, the two elements leaving between them a space shaped so as to constitute, at least in part, the bottom wall of the squealer. Preferably, the two elements—the squealer element and the element beneath the squealer—are joined together by at least one ceramic rod.

The advantage of the solution according to the invention is that the squealer bottom wall is formed in an industrial process during the casting operation.

According to another feature, the core includes a secondary core beneath the squealer. This secondary core is joined to the main core by at least one ceramic rod fastened to said element shaped so as to constitute the squealer.

This therefore allows relatively precise positioning of the assembled core elements, which is reproducible in an industrial process. Preferably, these rods also define orifices for extraction of the cooling fluid through the squealer.

More particularly, the secondary core provides, partly with the portions of the main core that are beneath the squealer, squealer the bottom wall.

The invention also relates to a method of manufacturing a core thus characterized, it being possible for this method to be implemented in several alternate ways.

According to a first way of manufacturing a core with a secondary core, the method comprises the following steps: manufacture of said main core; formation of at least one notch in the element shaped so as to constitute the squealer; fitting of the secondary core with the rod; and plugging of the notch. More particularly, the notch may be formed on the core before the latter is fired.

According to a variant, it comprises the following steps: manufacture of said main core; drilling of at least one hole in the element shaped so as to constitute the squealer; and fitting of the secondary core with the rod. More particularly, the drilling is carried out in the core before the latter is fired.

According to another variant, as the secondary core is drilled so as to form a housing for the rod, the secondary core is positioned without the rod and then the rod is fitted into its housing.

BRIEF DESCRIPTION OF THE DRAWINGS

Other features and advantages will become apparent on reading the following description of two embodiments of the invention, with reference to the appended drawings, in which.

DESCRIPTION OF THE EMBODIMENT OF THE INVENTION

Figure 3:
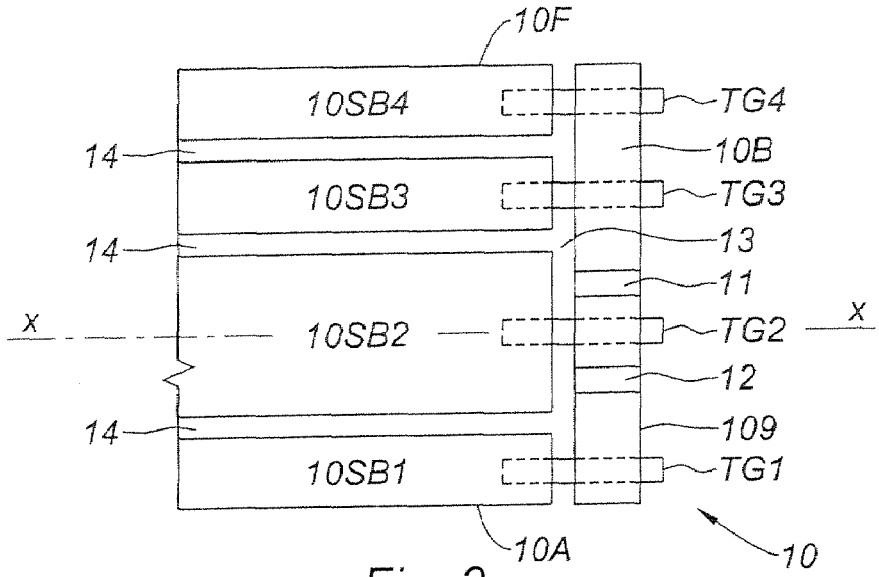
FIG. 3 shows schematically, seen partially along its height and in its largest width, a main core according to the invention.
Figure 4:
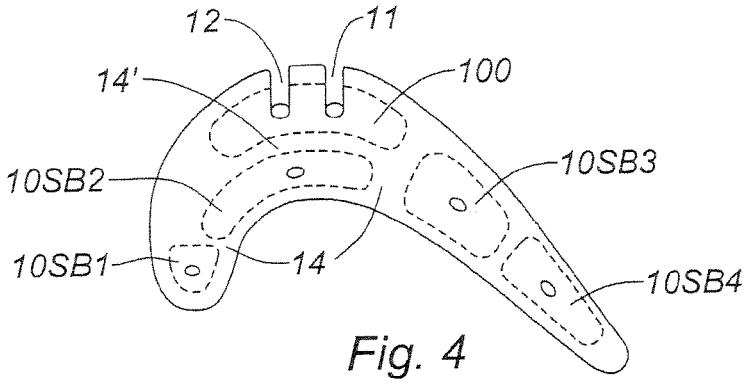
FIG. 4 is a view of the core of FIG. 7 in section on AA.

FIG. 3 shows, along the main axis XX of the blade, a portion of a main core which corresponds to the upper portion of the airfoil, the tip being to the right in the figure. The rest of the core corresponding to the portion of the blade with the root and the platform is not visible. This main core is, for example, the core on the pressure-face side of a multiple core. A multiple core allows hollow blades to be produced with multiple cavities separated by partitions, a cooling fluid circulating in said cavities. This cooling fluid may be air taken from the compressor, especially in a gas turbine engine. FIG. 4 shows an example of the overall profile of this main core.

Figure 1:
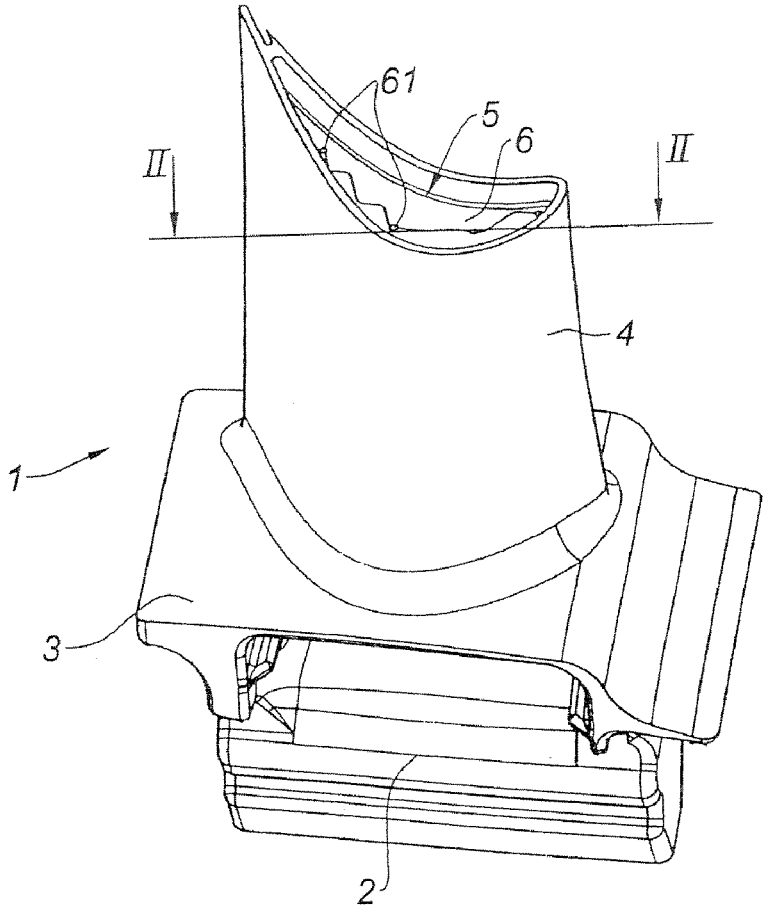
FIG. 1 shows, in perspective, a hollow moving turbine blade, the squealer of which may be seen.
Figure 2:
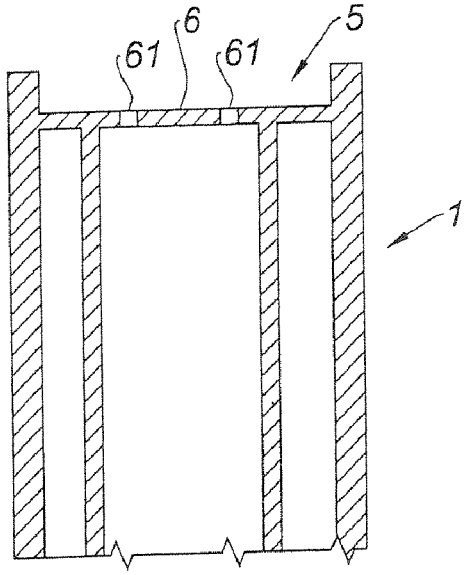
FIG. 2 is a sectional view on II—II through the squealer of the airfoil of FIG. 1.

This main core 10 here consists of a plurality of elements, separated from one another by spaces, constituting the walls of the cooling cavities after the metal has been cast. The schematic drawing of FIG. 3 shows an anterior edge 10A on the leading-edge side of the airfoil, a rear edge on the trailing-edge side of the airfoil, and a tip face 10S. It comprises the elements 10SB1, 10SB2, 10SB3 and 10SB4 along its axis. These elements are separated by defined spaces 14. A transverse element 10B extends over the entire width of the core 10 and is separated from the other elements 10SB by a transverse space 13. The space 13 is perpendicular to the spaces 14 and its width corresponds to that of a wall of the airfoil after the alloy has been cast. The element 10B, between the space 13 and the tip 10S, is shaped so as to provide the airfoil cavity referred to as the squealer in the description of FIG. 1 representing the airfoil. The space 13 bordering the element 10B is therefore intended to contain the metal that will form, at least in part, the bottom wall 6 of the squealer 5, which may be seen in FIG. 2.

The part 10SB to the left of the space 13 in the figure is shaped so as to provide cavities beneath the squealer on the blade as cast. In the embodiment shown, there are four elements 10SB1, 10SB2, 10SB3 and 10SB4, each giving rise to the formation of a cavity beneath the squealer. These elements are each joined to the transverse element 10B of the squealer by a ceramic rod TG1, TG2, TG3, TG4. These rods support the element 10B and keep the space 13 open.

Formed in the element 10B are two notches 11 and 12 parallel to the axis XX. These notches 11 and 12 are visible in FIG. 4. They may be obtained by machining the core before or after it is fired, or else at the core injection step, shaping the mold appropriately.

It may be seen in FIG. 4 that the main core is formed at the tip by the element 10B, which masks the elements 10SB1 to 10SB4 that are placed on the pressure-face side of the airfoil and are shown in dotted lines. A space is provided between the elements 10SB of the main core and the suction-face side of the blade.

Figure 5:
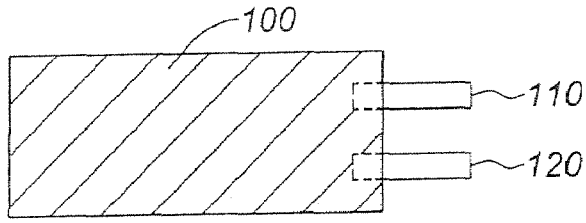
FIG. 5 shows schematically, seen partially along its height, a secondary core shaped so as to cooperate with the main core of FIG. 3 in order to constitute a core according to the invention.

A secondary core 100 is shown in FIG. 5. It is shaped so as partly to occupy the space that may be seen in FIG. 4, providing spaces 14' with the elements 10SB of the main core. These spaces 14 and 14' form partition walls internal to the airfoil after the metal has been cast.

Figure 6:
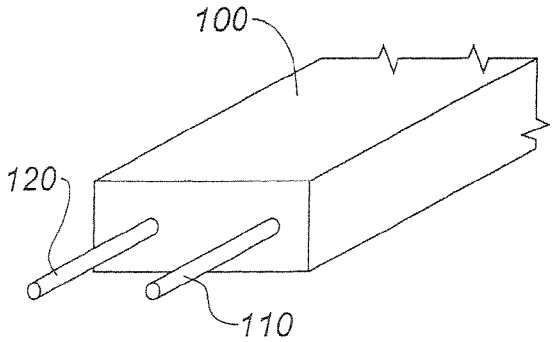
FIG. 6 shows the secondary core of FIG. 5, seen in perspective.

FIG. 5 shows two rods 110 and 120. These rods are shaped so as to be able to be housed in the notches 11 and 12 respectively. FIG. 6 shows the secondary core 100 in perspective, with the two rods inset into the upper face. The rods 110, 120 and the rods TG are made of a ceramic of the oxide, nitride or carbide type, or, for example, a combination of these materials. More particularly, the ceramic may be alumina, quartz or mullite. The rods may have been fitted during injection molding of the core so as to form a single part. It is also possible to machine the housings in the core 100 after it has been formed. The number of rods depends in particular on the geometrical constraints or else on the mechanical strength of the assembly, but there is at least one rod.

Figure 7:
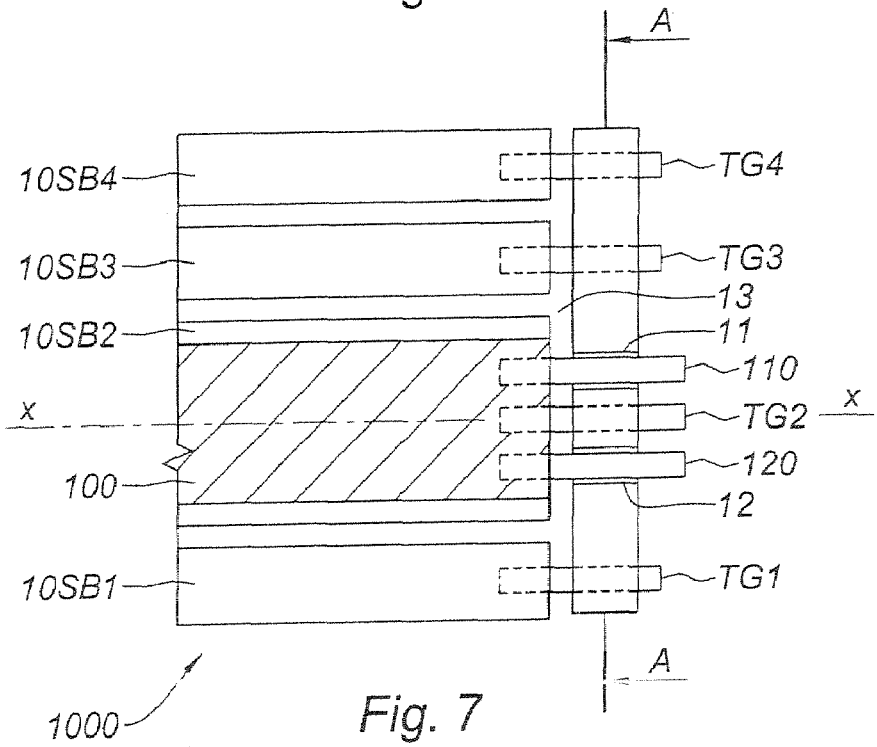
FIG. 7 shows the cores of FIGS. 3 and 5 after assembly.

FIG. 7 shows the main and secondary cores assembled, forming a multiple core 1000. The secondary core has been placed on the suction-face side relative to the main core. The core defines a portion of the space 13 via its face 100B (FIG. 5) and the space 14' (FIG. 4) together with the elements 10SB beneath the squealer of the main core 10.

The rods 110 and 120 are engaged in the notches 11 and 12 of the element 10B of the main core 10. After insertion of the rods, the notches are plugged by means of a ceramic adhesive comprising a mineral filler and a mineral binder. This may for example be a mixture of zircon and colloidal silica, or else alumina and ethyl silicate, or else silica and ethyl silicate. This is left to dry.

The core thus prepared then undergoes the conventional series of operations resulting in the manufacture of the blade: molding of the pattern, formation of the shell and casting of the alloy. It will be observed that this core results in the formation of a squealer bottom wall corresponding to the space 13.

Figure 8:
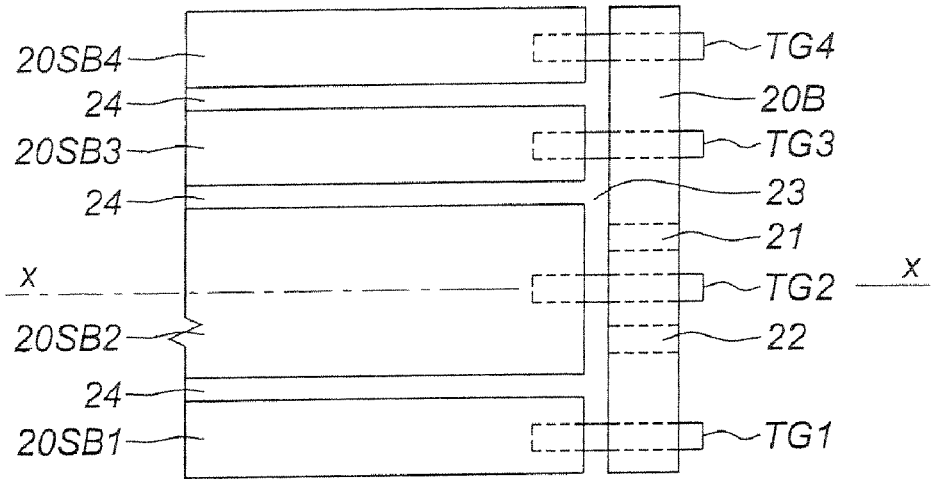
FIG. 8 shows, schematically, a partial view along its height and in the direction of its largest width, a main core according to one variant.
Figure 10:
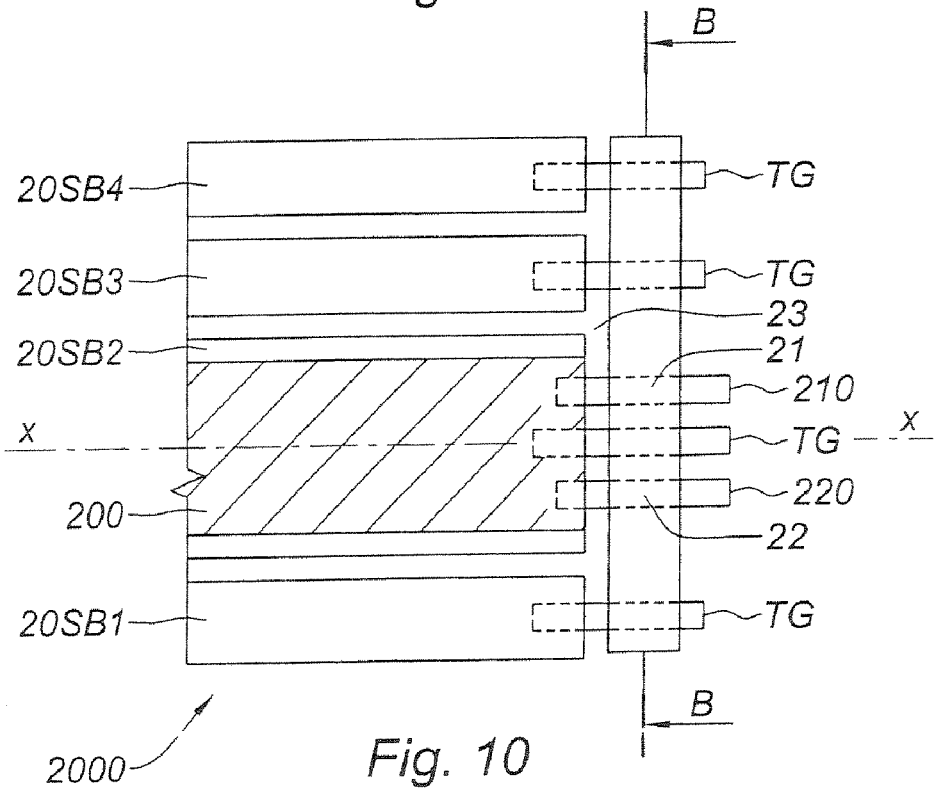
FIG. 10 shows the assembly of the main core of the variant of FIG. 8 with a secondary core.

According to the variant shown in FIGS. 8 and 10, the notches are replaced with holes forming housings 21 and 22. Apart from the housings 21 and 22, the main core 20 has the same features as the main core of FIG. 3. It has a squealer bottom space 23, a part 20B forming the squealer cavity, elements 20SB1, 20SB2, 20SB3 and 20SB4, parallel to the axis XX, and the edges 20A, 20S and 20F.

Figure 9:
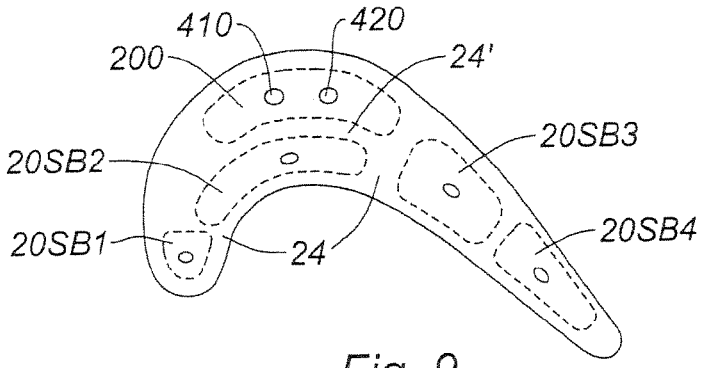
FIG. 9 is a view of the core of FIG. 10 in section on BB.
Figure 12:
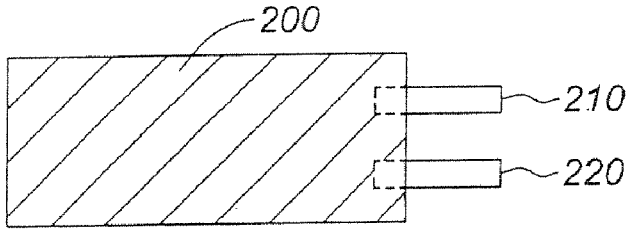
FIG. 12 shows, schematically, seen partially along its height, a secondary core shaped so as to cooperate with the main core of FIG. 8 in order to constitute a core according to the invention.

FIG. 9, which is a sectional view through the squealer element 20B perpendicular to the axis XX of the assembled core, shows the two holes made in the portion 20B. It also shows the spaces 24 and 24' between the various core elements, in order to form the partitions after the metal has been cast. FIG. 10 shows the core 2000 assembled with a secondary core 200, which may be seen by itself in FIG. 12. The secondary core is anchored in the squealer element 20B of the main core 20 by means of the ceramic rods 210 and 220.

As in the previous case, the core 200 is provided with two rods 210 and 220. The core 2000 is assembled by guiding the rods into the holes 21 and 22, respectively, and then by holding them in place, where appropriate by bonding.

Figure 11:
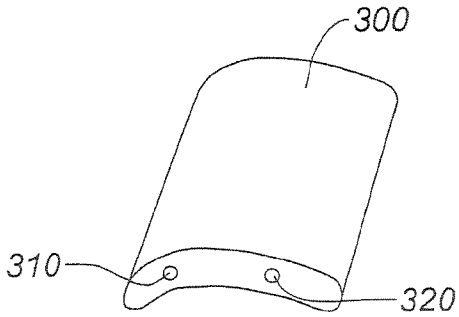
FIG. 11 shows a variant of the secondary core according to the invention.

When the geometry is complex, for example with a secondary core 300 as shown in FIG. 11, which does not allow mounting of the core 200 preassembled with the two rods, the procedure is different.

In this case, the secondary core 300 is drilled with two holes 310 and 320. The secondary core is presented parallel to the elements 20SB of the main core in such a way that the holes 310 and 320 face the holes 21 and 22. The rods are then slipped into the holes 21 and 310 on the one hand, and into the holes 22 and 320 on the other.

The core is ready for the subsequent operations in the manufacture of the blade.

The assembly of the cores has been shown in a simplified manner in order to bring out the principle of the invention. Of course, this is applicable to multiple cores consisting of a plurality of elementary cores or the like.

The invention claimed is:

1. A ceramic core used in the manufacture, by lost wax casting, of a finished turbomachine blade with cooling cavities and a squealer, said ceramic core comprising:

at least a main core, wherein the main core comprises a squealer element shaped so as to constitute the squealer of the finished turbomachine blade and a cavity element shaped so as to constitute at least one cavity beneath the squealer in the finished turbomachine blade, wherein a space between the squealer element and cavity elements is shaped so as to constitute, at least in part, bottom wall of the squealer in the finished turbomachine blade, wherein said squealer element has a first side facing said space and transverse to a longitudinal axis of said turbomachine blade, and a second side opposite to said first side, and wherein said squealer element defines at least two recesses extending through said squealer element from said first side to said second side, and a secondary core shaped to constitute another cavity beneath the squealer in the finished turbomachine blade, said secondary core being connected to said main core via said squealer element of said main core and not via said cavity element of said main core, wherein said secondary core is connected to said squealer element by at least two ceramic rods attached to said squealer element and to said secondary core, each ceramic rod being configured to fit inside a corresponding one of said recesses, said rods and said recesses being configured so as to allow adjustable and precise positioning of said main and secondary cores relative to each other.

2. The core as claimed in claim 1, wherein the secondary core is on a suction-face side of said turbomachine blade relative to the main core.

3. The core as claimed in claim 1, wherein each of the ceramic rods defines on the squealer bottom wall, an orifice for discharge of the cooling fluid.

4. A method of manufacturing a core as claimed in claim 1, wherein said method comprises the following steps:

manufacturing said main core;

forming said recesses in the squealer element;

fitting the ceramic rods in said recesses; and plugging said recesses.

5. The method as claimed in claim 4, further comprising firing said main core, and wherein the recesses are formed in the squealer element after the main core is fired.

6. The method as claimed in claim 4, wherein said forming of said recesses comprises drilling of at least one hole in the squealer element.

7. The method as claimed in claim 6, further comprising firing said main core, and wherein drilling is carried out before the main core is fired.

8. The method as claimed in claim 6, wherein, when the secondary core is drilled so as to form said hole, the secondary core is positioned without the ceramic rods attached to the secondary core.

9. A method of manufacturing a hollow turbomachine blade comprising the method as claimed in claim 4.

* * * * *

UNITED STATES PATENT AND TRADEMARK OFFICE

CERTIFICATE OF CORRECTION

PATENT NO. : 7,562,691 B2
APPLICATION NO. : 11/460091
DATED : July 21, 2009
INVENTOR(S) : Didier Guerche et al.

It is certified that error appears in the above-identified patent and that said Letters Patent is hereby corrected as shown below:

On the title page item (73) Assignee, change "Pris" to --Paris--.

Column 5, line 39, change "elements" to --element--.

Signed and Sealed this

Twenty-ninth Day of December, 2009

David J. Kappos

David J. Kappos
*Director of the United States Patent and Trademark Office*